US005079684A

United States Patent [19]

Lai

[11] Patent Number: 5,079,684

[45] Date of Patent: Jan. 7, 1992

[54] LAMP FOR A CEILING FAN

[76] Inventor: Wen K. Lai, No. 136, Sec. 3, Tung Hsing Rd., Hsi Chu, Taichung, Taiwan

[21] Appl. No.: 673,778

[22] Filed: Feb. 14, 1991

[51] Int. Cl.[5] ..... F21V 29/00

[52] U.S. Cl. ..... 362/294; 362/96; 362/370; 362/408

[58] Field of Search ..... 362/96, 294, 147, 263, 362/265, 307, 408, 370; 98/40.07

[56] References Cited

U.S. PATENT DOCUMENTS

| | | | |
|---|---|---|---|
| 2,201,153 | 5/1940 | Brown | 362/96 |
| 3,883,732 | 5/1975 | Peterson et al. | 362/294 |
| 4,382,400 | 5/1983 | Stutzman | 362/294 |
| 4,426,677 | 1/1984 | Dennis | 362/408 |
| 4,531,179 | 7/1985 | Baker | 362/370 |
| 4,685,038 | 8/1987 | Huang | 362/294 |
| 4,796,166 | 1/1989 | Greenberg | 362/294 |
| 4,831,505 | 5/1989 | Van Norman | 362/294 |

*Primary Examiner*—Stephen F. Husar
*Assistant Examiner*—Y. Quach
*Attorney, Agent, or Firm*—Staas & Halsey

[57] ABSTRACT

A lamp includes a reflective member attached to a bottom of a control box of a ceiling fan. A housing is coupled to the control box by an arm which is bent with an angle so that the housing is located below the control box. A device is provided to support pair of conductors within the housing. A light bulb is electrically coupled between the conductors so that light emitted from the light bulb is reflected by the reflective member in order lighten a room in which the ceiling fan is disposed.

5 Claims, 4 Drawing Sheets

LAMP FOR A CEILING FAN

FIELD OF THE INVENTION

The present invention relates to a lamp, and more particularly to a lamp for a ceiling fan.

BACKGROUND OF THE INVENTION

Generally, the lamps for ceiling fan have a wattage ranging from 5 to 100. As far as applicant is aware, there is no lamp for ceiling fan which uses halogen light bulbs, because the wattage of the halogen light bulb is very large and the light emitted from the halogen light bulb is very strong so that the ceiling fan may be damaged or burned by the heat generated from the halogen light bulb.

The present invention has arisen to provide a lamp for ceiling fan which can use a halogen light bulb.

SUMMARY OF THE INVENTION

The primary objective of the present invention is to provide a lamp for a ceiling fan in which a halogen light bulb can be used.

In accordance with one aspect of the invention, there is provided a lamp for a ceiling fan in which the ceiling fan has a control box disposed in a middle and lower portion. The lamp includes a reflective member attached to a bottom of the control box. A housing is coupled to the control box by an arm which is bent with an angle so that the housing is located below the control box. A device is provided to support a pair of conductors within the housing. A light bulb is electrically coupled between the conductors so that light emitted from the light bulb is reflected by the reflective member in order to lighten a room in which the ceiling fan is disposed.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
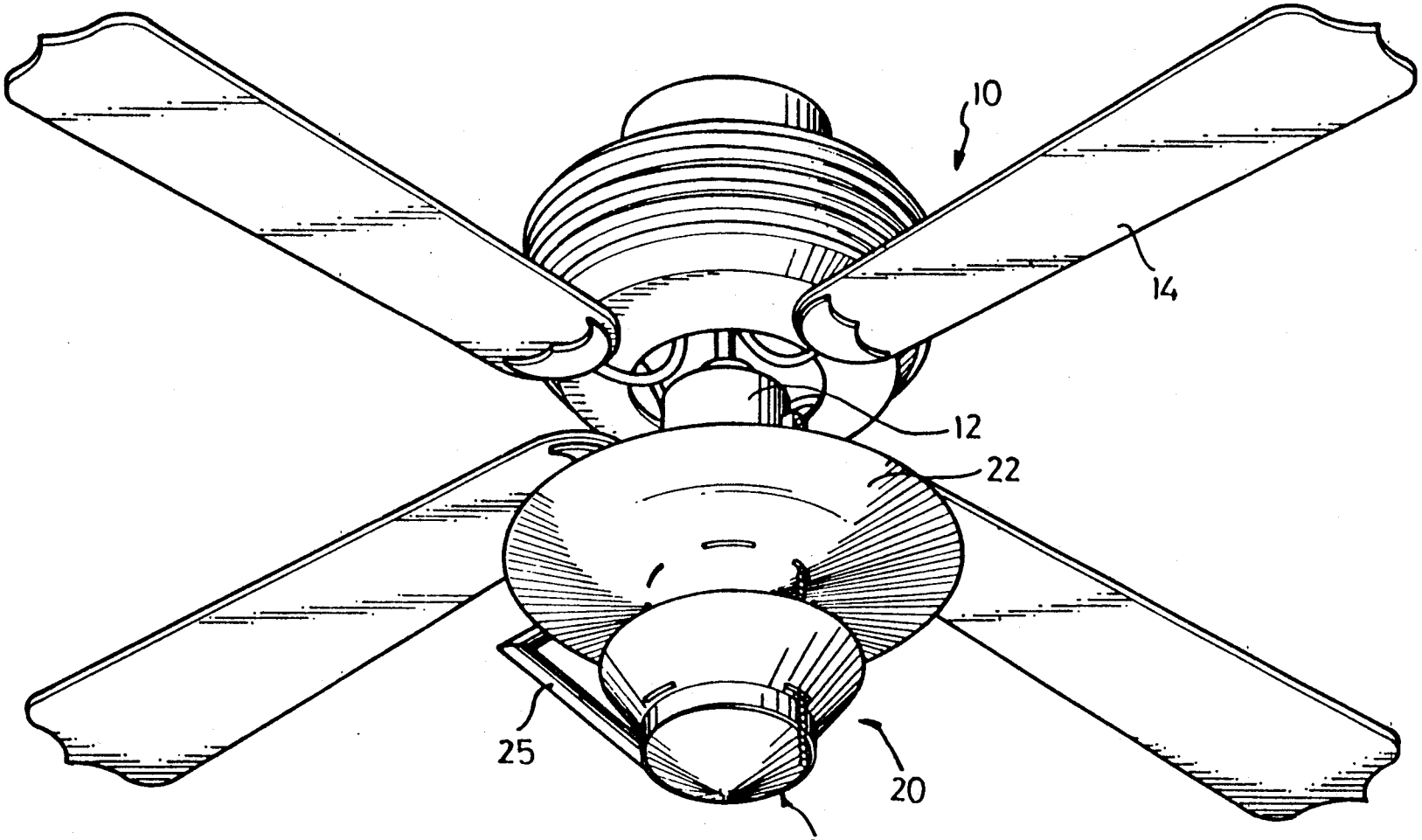
FIG. 1 is a perspective view of a lamp in accordance with the present invention which is attached to a ceiling fan.

Referring to the drawings and initially to FIG. 1, a lamp 20 in accordance with the present invention is attached to a control box 12 of a ceiling fan 10 which is substantially located below the fan blades 14. The lamp 20 comprises generally a reflective member 22 which is attached to the bottom of the control box 12, and a housing 30 which is coupled to the control box 12 by an arm 25 which is bent with an angle so that the housing 30 is located below the reflective member 22.

Figure 2:
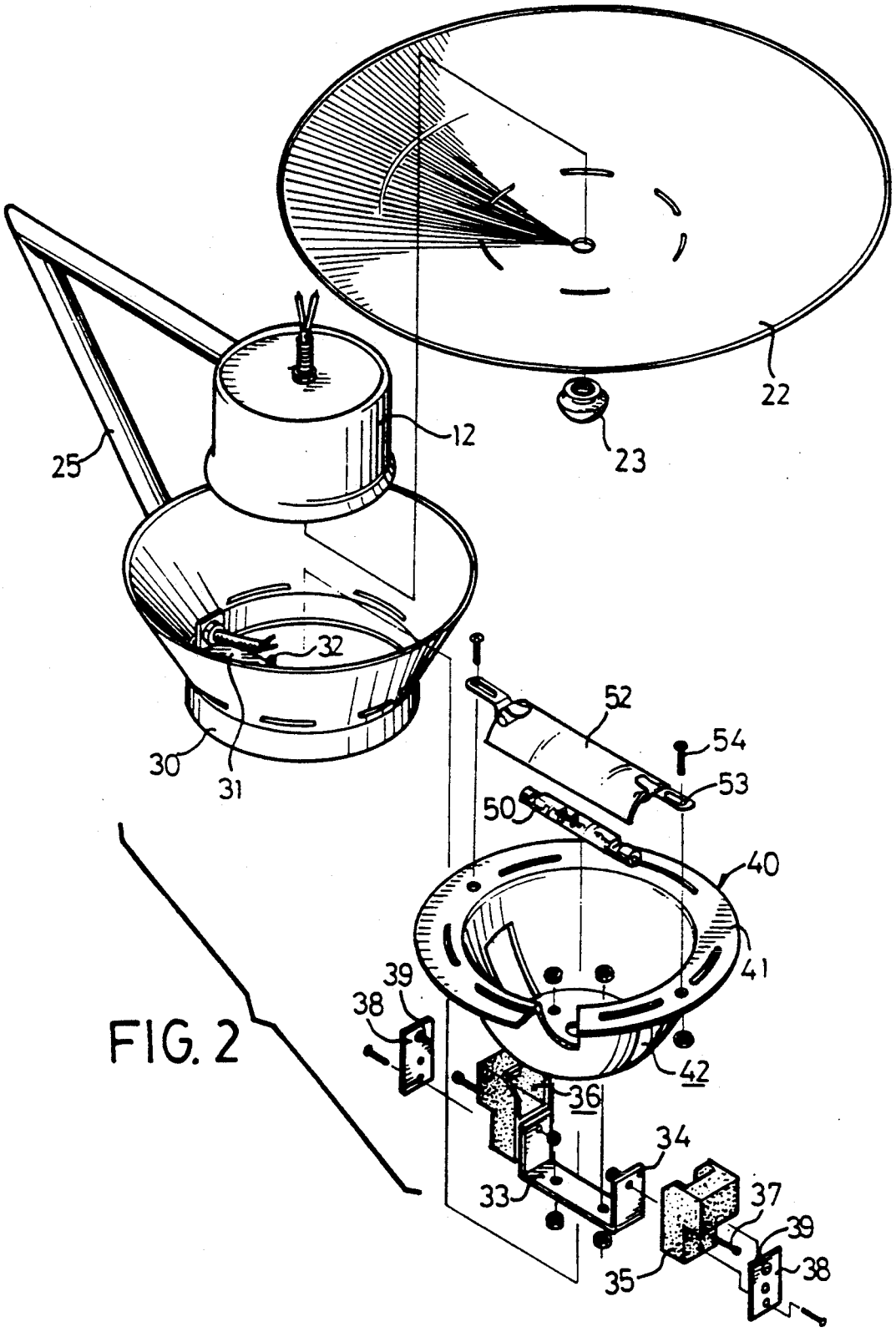
FIG. 2 is an exploded view of the lamp.
Figure 3:
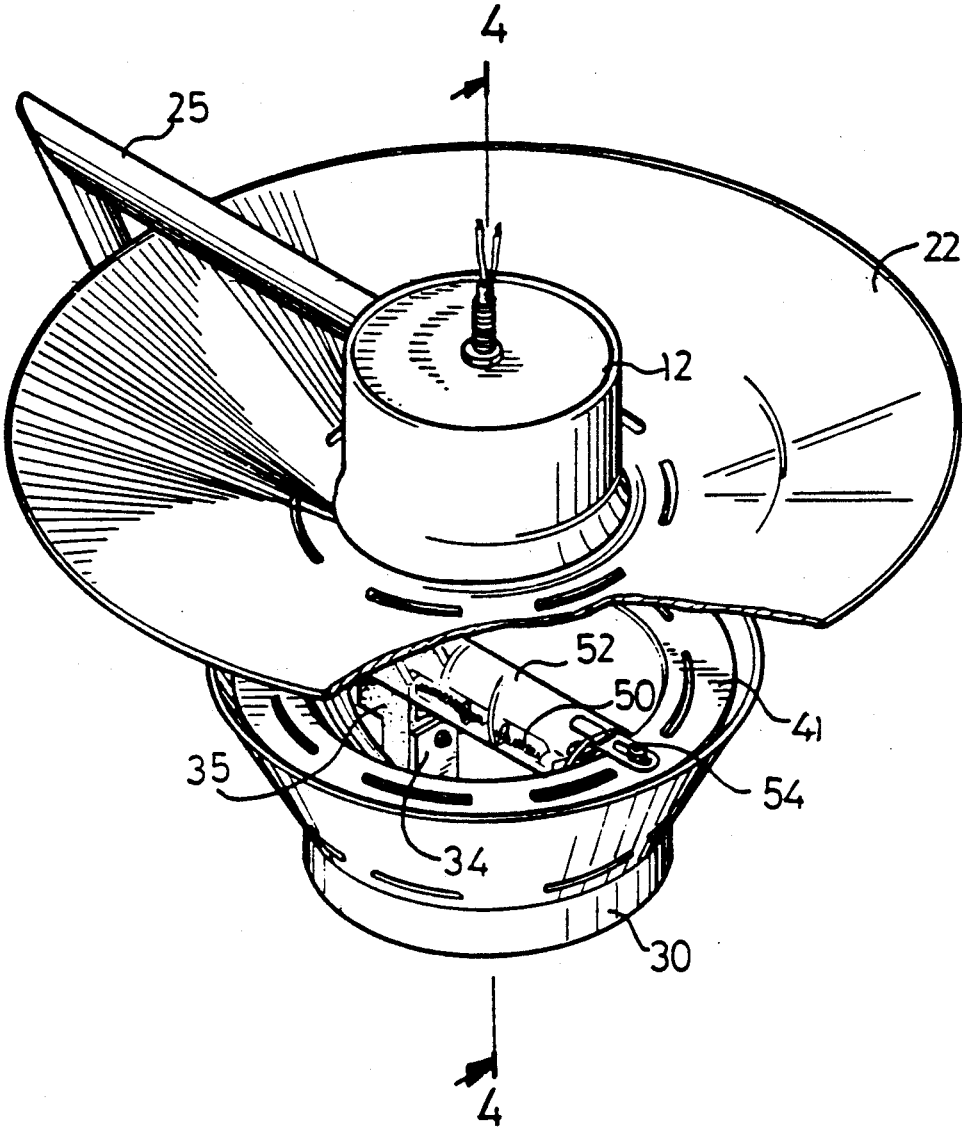
FIG. 3 is a perspective view of the lamp, in which, for clearly illustration purposes, part of the reflective member is cut off.
Figure 4:
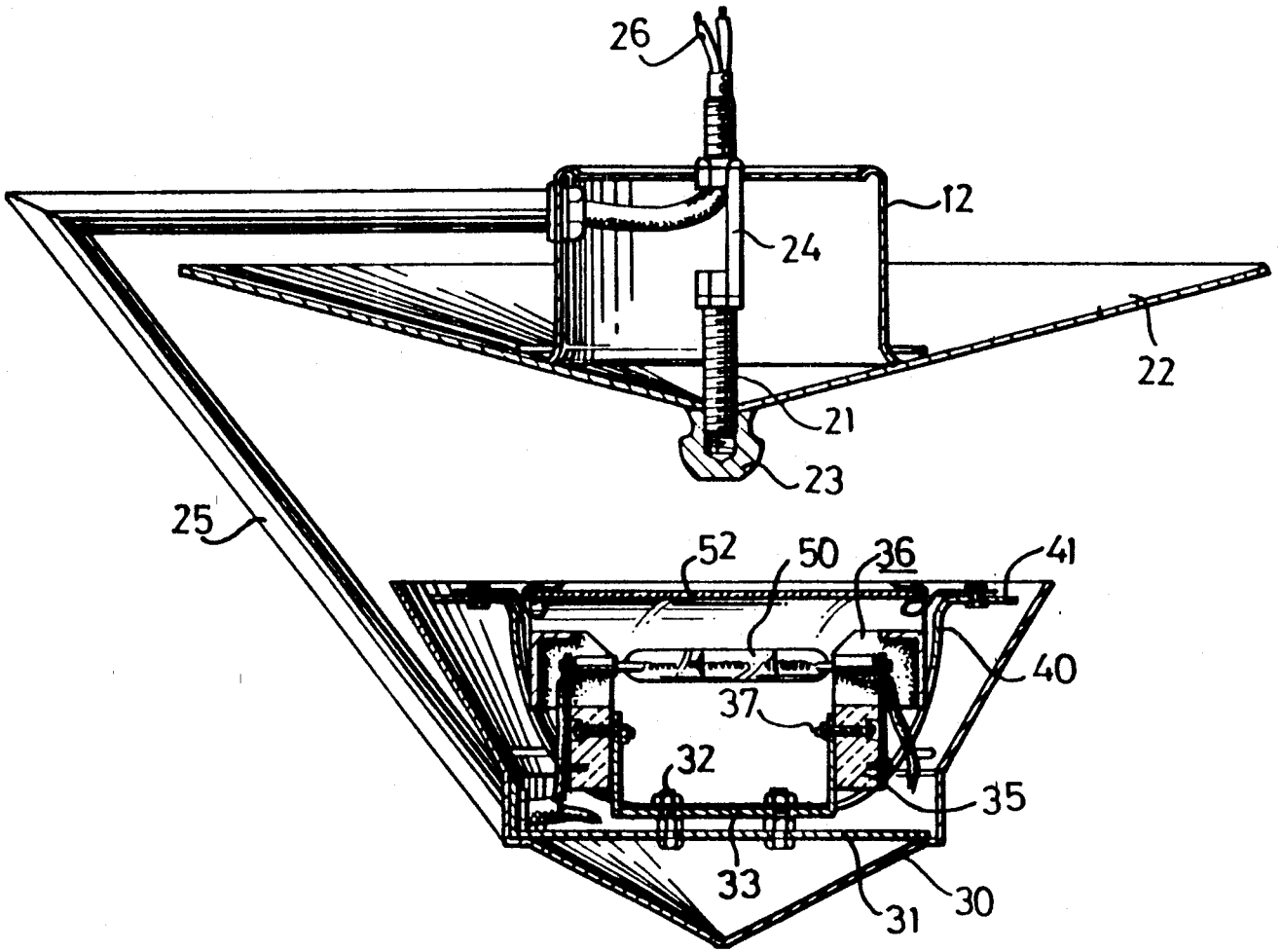
FIG. 4 is a cross sectional view taken along lines 4—4 of FIG. 3.

Referring next to FIGS. 2, 3 and 4, the arm 25 which is made of hollow tube has one end integrally fixed to the control box 12 and has another end fixed to the housing 30. A pair of wires 26 which extended from the ceiling fan 10 pass through the arm 25 to the housing 30.

A bolt 21 has an upper end fixed to the middle portion of the control box 12 by an extension 24 and has a lower end extended downward beyond the control box 12. The reflective member 22 is cone shaped and is supported by a nut 23 which is threadedly engaged to the lower end of the bolt 21 so that the reflective member 22 diverges outward and slightly diverges upward. The lower surface of the reflective member 22 can be painted with beautiful patterns or drawings for decorative purposes.

A strip 31 is fixed in the botton of the housing 30, and two bolts 32 are fixed on the strip 31. A lamp shade 40 which has a semi-spherical shape has an annular flange extended outward from the upper edge of the lamp shade 40. Two openings 42 are oppositely formed in the lower peripheral surface of the lamp shade 40. A bracket 33 has two lugs 34 extended upward through the openings 42 into the lamp shade 40. The bolts 32 fix the lamp shade 40 and the bracket 33 together. A pair of insulators 35 have a lower end fixed to the lugs 34 of the bracket 33 by bolts 37. A recess 36 is formed in the upper and inner portion of each of the insulators 35.

A lower end of a conductor 38 is fixed to the outer surface of each of the insulators 35 by such as bolts. The upper ends of the conductors 38 extend into the recess 36 of the respective insulators 35. A protrusion 39 extends inward from the upper end of each of the conductors 38. It is to be noted that the heads of the bolts 37 are embedded within the insulators 35 so that the bolts 37 will not contact the conductors 38. A halogen light bulb 50 or other light bulb which emits strong light is held in place by the resilient force of the conductors 38 so that the ends of the halogen light bulb 50 electrically contact the protrusions 39. The conductors 38 are connected to the wires 26 respectively. A transparent sheet 52 is supported by a pair of holders 53 which are fixed to the annular flange 41 of the lamp shade 40 by such as bolts 54 so that the transparent sheet 52 is located above the halogen light bulb 50.

When the halogen light bulb 50 is turned on, the light emitted from the halogen light bulb 50 passes through the transparent sheet 52 so that the intensity of the light will be slightly decreased. The light is then reflected by the reflective member 22 in order to lighten the room in which the ceiling fan 10 is disposed so that the light will not lighten the room directly and so that the intensity of the light will be lowered. In addition, the reflective member 22 prevents the ceiling fan 10 from being lightened by the halogen light bulb 50 so that the ceiling fan 10 will not be damaged or burned by the heat generated by the halogen light bulb.

Accordingly, the lamp for a ceiling fan in accordance with the present invention can use the halogen light bulb or other light bulbs which emit strong light beams, in which the ceiling fan will not be damaged or burned by the light bulb.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A lamp for a ceiling fan, said ceiling fan having a control box disposed in a middle and lower portion thereof, said lamp comprising a reflective member attached to a bottom of said control box; a housing being coupled to said control box by an arm which is bent with an angle so that said housing is located below said control box; means for supporting a pair of conductors within said housing; and a light bulb electrically coupled between said conductors so that light emitted from said light bulb is reflected by said reflective member in order to lighten a room in which said ceiling fan is disposed.

2. A lamp according to claim 1, wherein said arm is made of hollow tube, and a pair of wires which extended from said ceiling fan pass through said arm into said housing and are coupled to said conductors respectively.

3. A lamp according to claim 1, wherein a lamp shade which has a semi-spherical shape is received within said housing, two openings are formed in a peripheral surface of said lamp shade; said means comprises a U-shaped bracket which has two lugs extended through said openings into said lamp shade, said lamp shade and said bracket are fixed to a bottom of said housing, a pair of insulators are coupled to said lugs respectively, a recess is formed in an inner and upper portion of each of said insulators for receiving a respective conductor, said light bulb is electrically connected to said conductors and held by said conductors, and said light emitted from said light bulb is reflected by said reflective member in order to lighten said room.

4. A lamp according to claim 3, wherein a lower end of each of said conductors is fixed to a respective insulator and an upper end thereof extends into said recess of said insulator, a protrusion extends inward from said upper end of each of said conductors, said light bulb are held between said protrusions by a resilient force of said conductors so that said light bulb can be retained in place.

5. A lamp according to claim 3, wherein said light bulb is a halogen light bulb, a strip is fixed in said bottom of said housing, said lamp shade and said bracket are fixed to said strip, an annular flange is formed and extends outward from an upper peripheral edge of said lamp shade, a transparent sheet is supported above said light bulb by a pair of holders which are fixed to said annular flange so that said light passes through said transparent sheet before reaching said reflective member, and so that an intensity of said light emitted from said light bulb is decreased.

* * * * *